343-700 MS AU 251 EX
11/24/87 OR 4,709,239

United States Patent [19]

Herrick

[11] Patent Number: 4,709,239

[45] Date of Patent: Nov. 24, 1987

[54] DIPATCH ANTENNA

[75] Inventor: David L. Herrick, Hudson, N.H.

[73] Assignee: Sanders Associates, Inc., Nashua, N.H.

[21] Appl. No.: 773,699

[22] Filed: Sep. 9, 1985

[51] Int. Cl.[4] ..... H01Q 1/38; H01Q 1/28

[52] U.S. Cl. ..... 343/700 MS; 343/705; 343/745; 333/246; 333/247

[58] Field of Search ..... 343/745-751, 343/700 MS, 705, 708, 754, 786, 785, 829, 830, 846, 853; 333/246-247

[56] References Cited

U.S. PATENT DOCUMENTS

| | | | |
|---|---|---|---|
| 3,665,480 | 5/1972 | Fassett | 343/754 |
| 3,921,177 | 11/1975 | Munson | 343/846 |
| 4,051,480 | 9/1977 | Reggia et al. | 343/705 |
| 4,053,895 | 10/1977 | Malagisi | 343/700 MS |
| 4,167,010 | 9/1979 | Kerr | 343/700 MS |
| 4,210,793 | 7/1980 | Fournet-Fayas | 343/772 |
| 4,259,670 | 3/1981 | Schiavone | 343/700 MS |
| 4,367,474 | 1/1983 | Schaubert et al. | 343/700 MS |
| 4,379,296 | 4/1983 | Farrar et al. | 343/700 MS |
| 4,410,891 | 10/1983 | Schaubert et al. | 343/700 MS |

OTHER PUBLICATIONS

D. H. Schaubert, H. S. Jones, and F. Reggia; "Conformal Dielectric-Filled Edge-Slot Antennas with Inductive-Post Tuning", *IEEE Transactions on Antennas and Propagation*, vol. AP-27, No. 5, Sep. 1979, pp. 713 through 716.

D. H. Schaubert, F. G. Farrar, Arthur Sindoris, and S. T. Hayes; "Microstrip Antennas with Frequency Agility and Polarization Diversity", *IEEE Transactions on Antennas and Propagation*, vol. AP-29, No. 1, Jan. 1981, pp. 118-123.

*Primary Examiner*—Marvin L. Nussbaum
*Attorney, Agent, or Firm*—Richard I. Seligman; Stanton D. Weinstein

[57] ABSTRACT

A vertically polarized omnidirectional antenna adapted for use in airborne, Very High Frequency (VHF) applications is disclosed. The antenna is configured as a conductive patch spaced over its virtual image. The addition of a number of switching devices allows operation over a five-to-one bandwidth while maintaining a two-to-one Voltage Standing Wave Ratio.

9 Claims, 9 Drawing Figures

DIPATCH ANTENNA

BACKGROUND OF THE INVENTION

The present invention relates to antennas and more particularly to a dispatch antenna providing vertical polarization and wideband, rapid tuning in an aerodynamically efficient package.

The communications systems requirements of modern aircraft have placed increasing demands on antenna design. As of yet, the need for efficient, high powdered transmission in the Very High Frequency (VHF) and Ultra High Frequency (UHF) band with vertical polarization from small aircraft has not been satisfactorily achieved. An ideal antenna would have an aerodynamically efficient shape, less than one square foot forward cross-sectional area, and be adapted for existing aircraft antenna pods. Such an antenna should have a substantially omnidirectional radiation pattern while maintaining a Voltage Standing Wave Ratio (VSWR) of less than to one (2:1) over a five to one (5:1) tuning range. In environments employing frequency agile modulation, such as frequency division multiple access, the ability to tune to a new frequency with minimum settling time is also important.

One approach to this problem has been to use an array of electrically very small antenna elements. Each element is carefully tuned using an external automatic matching system or a resistive network to reduce the VSWR. Such arrays, besides being fairly complex electrically, exhibit attendant mechanical design complications such as weight, physical size, and packaging to withstand device enviromental conditions such as shock and vibration. The arrays can be used at a newly tuned frequency only after the settling time of the matching system, typically milliseconds, has passed.

It is also known that a parallel plate antenna configured as a thin disk of dielectric material plated on both sides can be used as an edge slot radiator to achieve the required vertical polarization. Rows of diametrically opposed tuning posts can be used to set the operating frequency. See, for example, D. H. Schaubert, H. S. Jones, Jr. and F. Reggia, "Conformal Dielectric-Filled Edge-Slot Antennas with Inductive-Post Tuning," *IEEE Transactions on Antennas and Propagation,* vol. AP-27, No. 5, pp. 713-716 September 1979. The edge slot has the desired vertical polarization. However, the basic parallel plate structure exhibits a typical 2:1 VSWR bandwidth of only approximately three to five percent. Additionally, the disk shape is not particularly adaptable to existing aerodynamic pods.

Others have demonstrated tunable microstrip patch antennas for microwave frequencies, embodied as a patch of metal separated from a ground plane by a dielectric medium. Diametrically opposed short circuiting switches such as diodes are disposed between the patch and the ground plane, and selectively switched to control the antenna. See, for example, U. S. Pat. No. 4,053,895 issued Oct. 11, 1977 to C. S. Malagisi and also see D. H. Schaubert, F. G. Farrar, A. Sindoris and S. T. Hayes, "Microstrip Antennas with Frequency Agility and Polarization Diversity," *IEEE Transactions on Antennas and Propagation,* vol. AP-29, No. 1, pp. 118-123, January 1981. These antennas exhibit a 2:1 VSWR bandwidth of five to ten percent, so that a large number of diode shorts would still be necessary to cover the desired tuning range. Direct scaling of the microstrip patch over ground antenna to VHF frequencies requires a comparatively large ground plane, again difficult to conform to existing aircraft antenna pods.

SUMMARY OF THE INVENTION

Accordingly, it is a general object of the present invention to provide a new and improved vertically polarized omnidirectional antenna.

Another object of the present invention is to provide an antenna easily adaptable to existing aerodynamic packaging techniques.

A further object of the present invention is to provide an antenna which is rapidly tunable.

Yet another object of the present invention is to provide an antenna capable of maintaining a VSWR of less than two to one over at least a five to one bandwidth.

A still further object of the present invention is to provide an antenna suitable for efficient, high power transmission in excess of one kilowatt.

Briefly, these and other objects are accomplished by an antenna configured as a conductive patch spaced over its image. This eliminates the need for a ground plane and its associated disadvantages. The patches are shaped to conform to the various existing aircraft antenna packages, such as pods. The use of air as a dielectric substantially increases the instantaneous bandwidth available at the frequencies of interest. The addition of approximately ten shorting devices, disposed along and connected between the patches to provide electrical shorts at selectable positions, allows rapid tuning over a 5:1 bandwidth while maintaining the desired 2:1 VSWR.

These and still other objects, advantages and novel features of the present invention are apparent from the following detailed description when considered together with the accompanying drawings.

DETAILED DESCRIPTION OF THE PREFERRED EMBODIMENT

Figure 1:
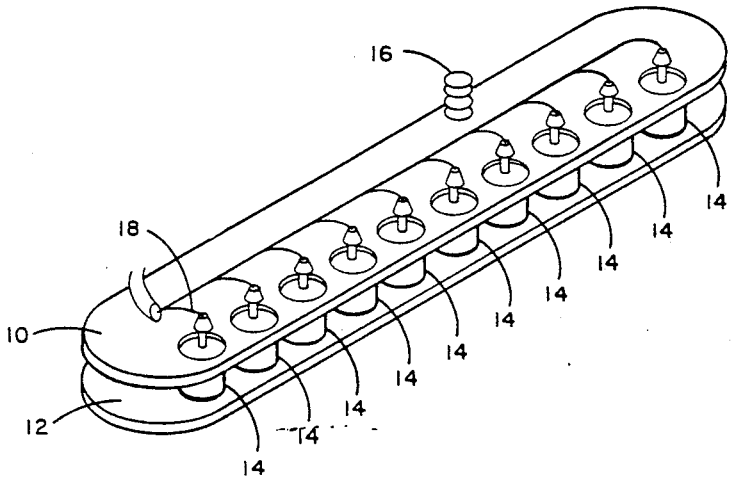
FIG. 1 is an isometric view of a preferred embodiment of the dipatch antenna in accordance with the present invention.

Turning attention now to the drawings, in which like reference numerals designate like or corresponding parts throughout the several views, there is shown in FIG. 1 an isometric view of the preferred embodiment. An upper conductive metallic plate 10 is used as a patch type antenna element. This upper patch 10 is configured to conform to the geometry of existing aerodynamic pods. Its length should be approximately equal to one-half the wavelength of the lowest frequency of interest. A lower patch 12 is positioned beneath the top patch 10. This lower patch 12 is physically identical to the upper patch 10 and positioned and electrically operated to form the image of upper patch 10. Radio frequency energy is coupled to upper patch 10 and lower patch 12. Input coaxial connector 16 provides an input from the radio frequency source (not shown). Connection of such a coaxial connector is further described in U.S. Pat. No. 4,053,895 issued Oct. 11, 1977 to C. S. Malagisi, which is hereby incorporated by reference. Particular attention is directed to FIGS. 1 and 3, to column 2, lines 32 and 33, and to column 2, line 64 through column 3, line 10, of U.S. Pat. No. 4,053,895. Such connection is also described in D. H. Schaubert, H. S. Jones, Jr. and F. Reggia "Conformal Dielectric-Filled Edge-Slot Antennas with Inductive-Post Tuning" in *IEEE Transactions on Antennas and Propagation,* Vol. AP-27, No. 5, Sept. 1979, pp 713–716 and in D. H. Schaubert, F. G. Farrar, A. Sindoris and S. T. Hayes "Microstrip Antennas with Frequency Agility and Polarization Diversity" in *IEEE Transactions on Antennas and Propagation, Vol. AP*-29, No. 1 Jan. 1981, pp 118–123. Particular attention is directed to FIG. 1 at page 714 of the earlier paper by Schaubert et al., and FIG. 1 at page 119 and FIG. 8 at page 123 of the subsequent paper by Schaubert et al.

A plurality of shorting modules 14, are linearly disposed along the major axis of and between conductive patches 10 and 12. Shorting modules 14 need not be positioned exactly on the major axis, but merely parallel to it, as shifting a bit off-center only adjusts the driving point impedance. Each shorting module 14 has a bias control lead 18 used to switch each shorting module 14 between a full-on and full-off state. The bias control leads 18 are connected through cabling to a bias control circuit (not shown) which controls the state of each shorting module 14. Shorting modules 14, preferably comprised of Positive-Intrinsic Negative (PIN) diodes, having low on resistance and high off resistance to minimize DC power dissipation and thus maximizing radio frequency (RF) power handling capacity.

Experimentation has shown that for operation in the VHF/UHF radio frequency band, such as approximately 600 to 3000 megahertz, the upper and lower patches, 10 and 12, are approximately 9 inches in length and 2½ inches in width, with the air space between patches 10 and 12 being approximately ⅜ of an inch. Approximately ten shorting modules 14 are sufficient to cover this frequency range.

Operation at lower frequencies for a given patch length is possible with the use of high permittivity dielectric between patches 10 and 12. In this instance, additional shorting modules 14 would be necessary due to a corresponding decrease in percent bandwidth.

Figure 2:
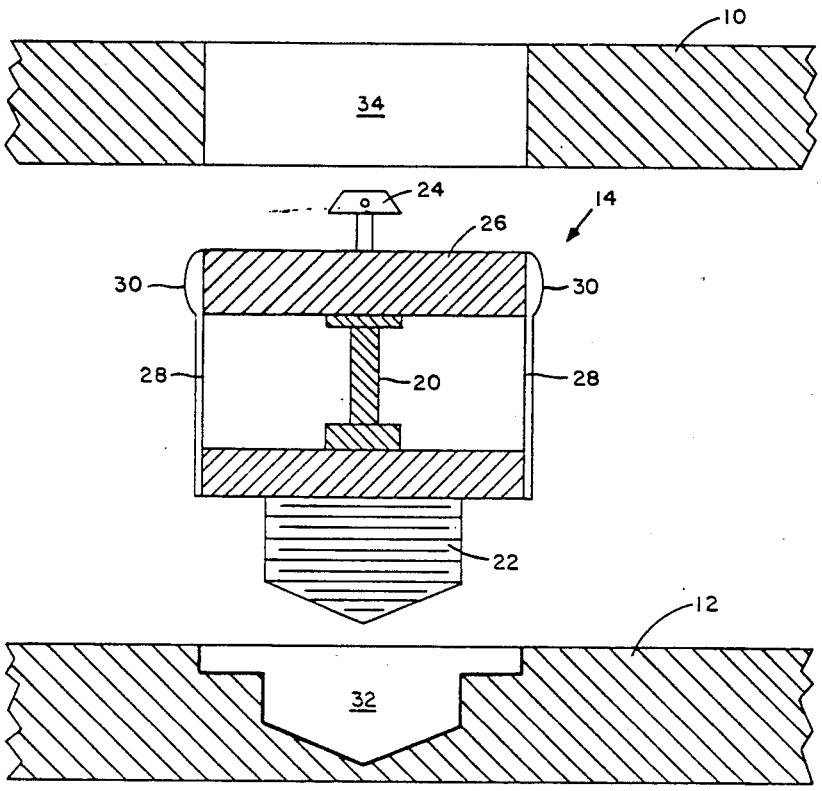
FIG. 2 is a partial cross sectional view of the embodiment of FIG. 1 showing a preferred diode mounting technique.

FIG. 2 is a more detailed view of a shorting module 14 and its interface with upper patch 10 and lower patch 12. In the preferred embodiment, shorting module 14 comprises a PIN diode 20 in a stud mount configuration, so that the screw threads 22 at the bottom of the stud mount engage the lower patch 12 via the tapped threaded hole 32 formed as a part of lower patch 12. The bias control lead 18 associated with each shorting module 14 is preferably connected to the PIN diode 20's bias control input with a push on lug 24 or similar input terminal. A capacitive bypass network 26 is preferably disposed between push-on lug 24 and the PIN diode 20 to shunt RF currents to the upper patch 10, thereby effectively filtering any switching transients out of bias control line 18. A cylindrical sleeve 28 is preferably fitted around the lug 24, bypass network 26, PIN diode 20 and stud mount 22 assembly. The sleeve 28 has a compresssive portion 30, which allows the PIN diode 20 to both electrically and mechanically engage the upper patch 10 when the shorting module 14 is properly positioned underneath the holes 34 formed as a part of upper patch 10.

Figure 3:
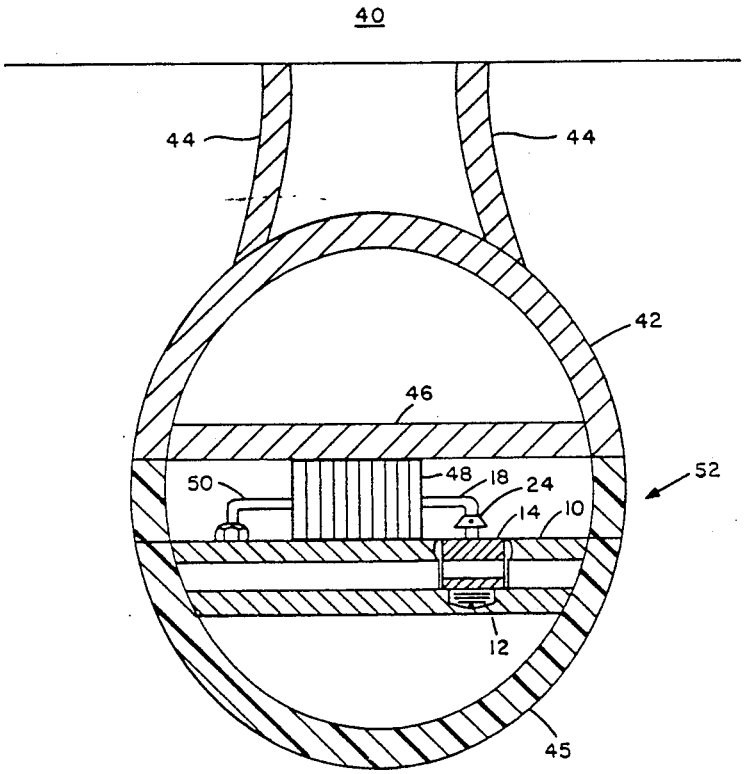
FIG. 3 is a cross sectional view of a preferred embodiment of a conformal aircraft pod mounting arrangement for the present invention.

FIG. 3 is a cross-sectional view of the pod mounting arrangement for the present invention underneath the wing 40 of an aircraft. The aerodynamic pod 42 is mechanically attached to the aircraft wing 40 via a pylon 44. The pod 42 is typically formed of a lightweight metal such as aluminum so that a radome 45 of suitable RF transparent material is necessary to allow the antenna to radiate properly, while protecting the electronics from the elements. The assembly 52, which includes power amplifier 48, upper patch 10, lower patch 12, and shorting modules 14, is suitably mounted to hardback 46. The output of power amplifer 48 is fed through RF drive cable 50 connected to RF drive input 16 (not shown in FIG. 3). Bias control leads 18 are fed from the bias control circuit (not shown) to the shorting modules 14 via the push on lugs 24.

Figure 4:
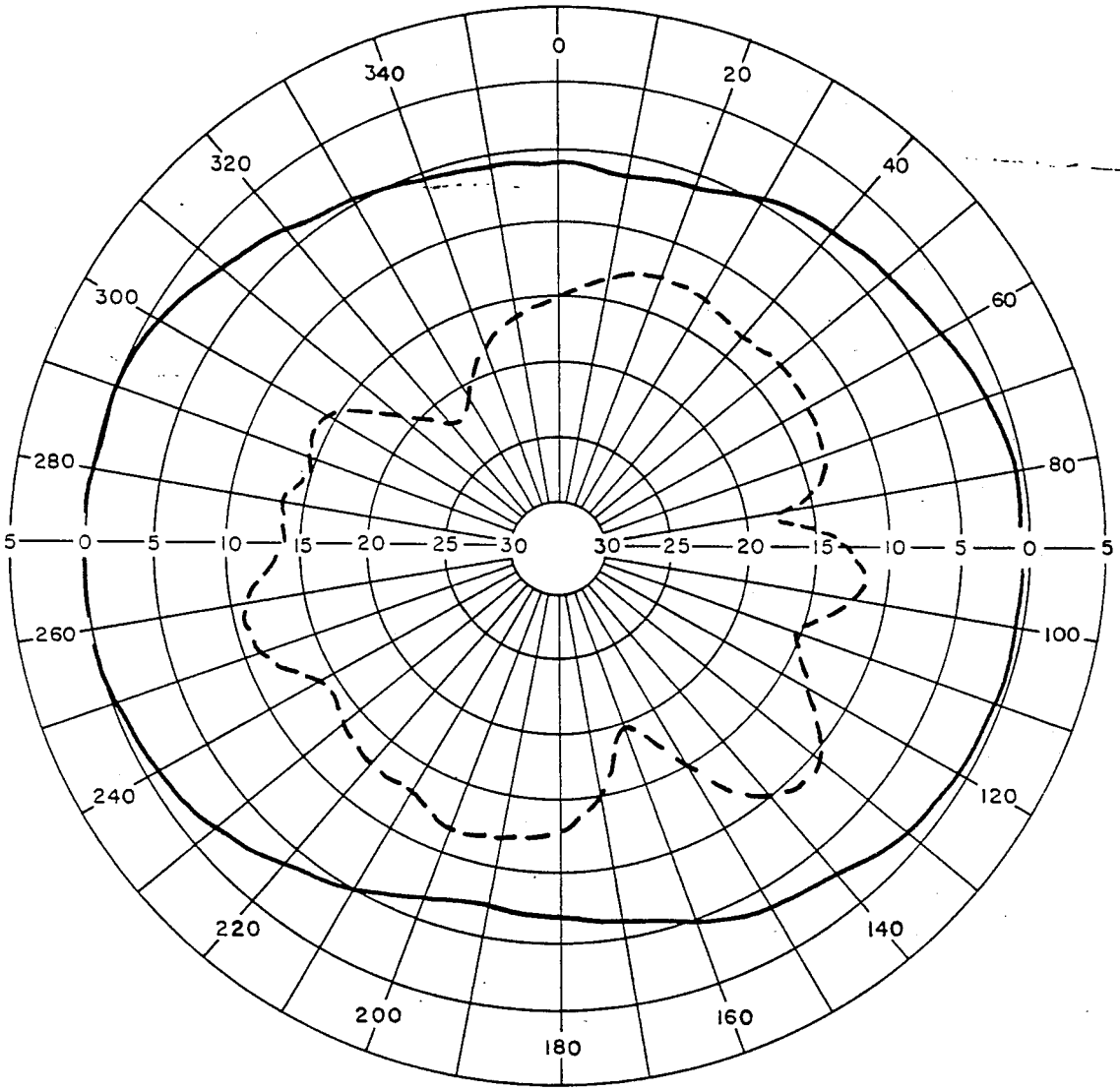
FIGS. 4-9 show various radiation patterns obtained using the embodiment of FIG. 1.
Figure 5:
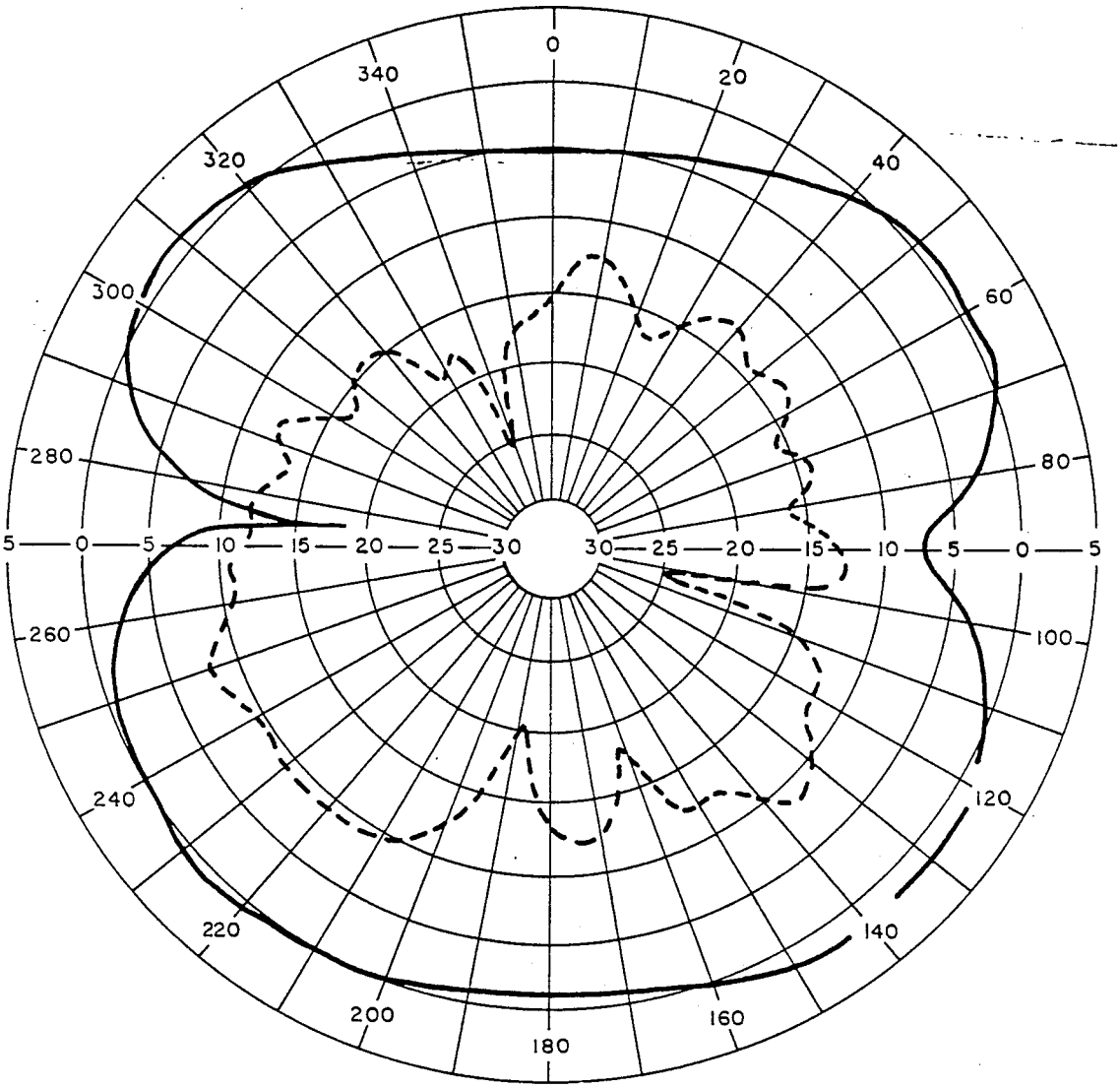
Figure 6:
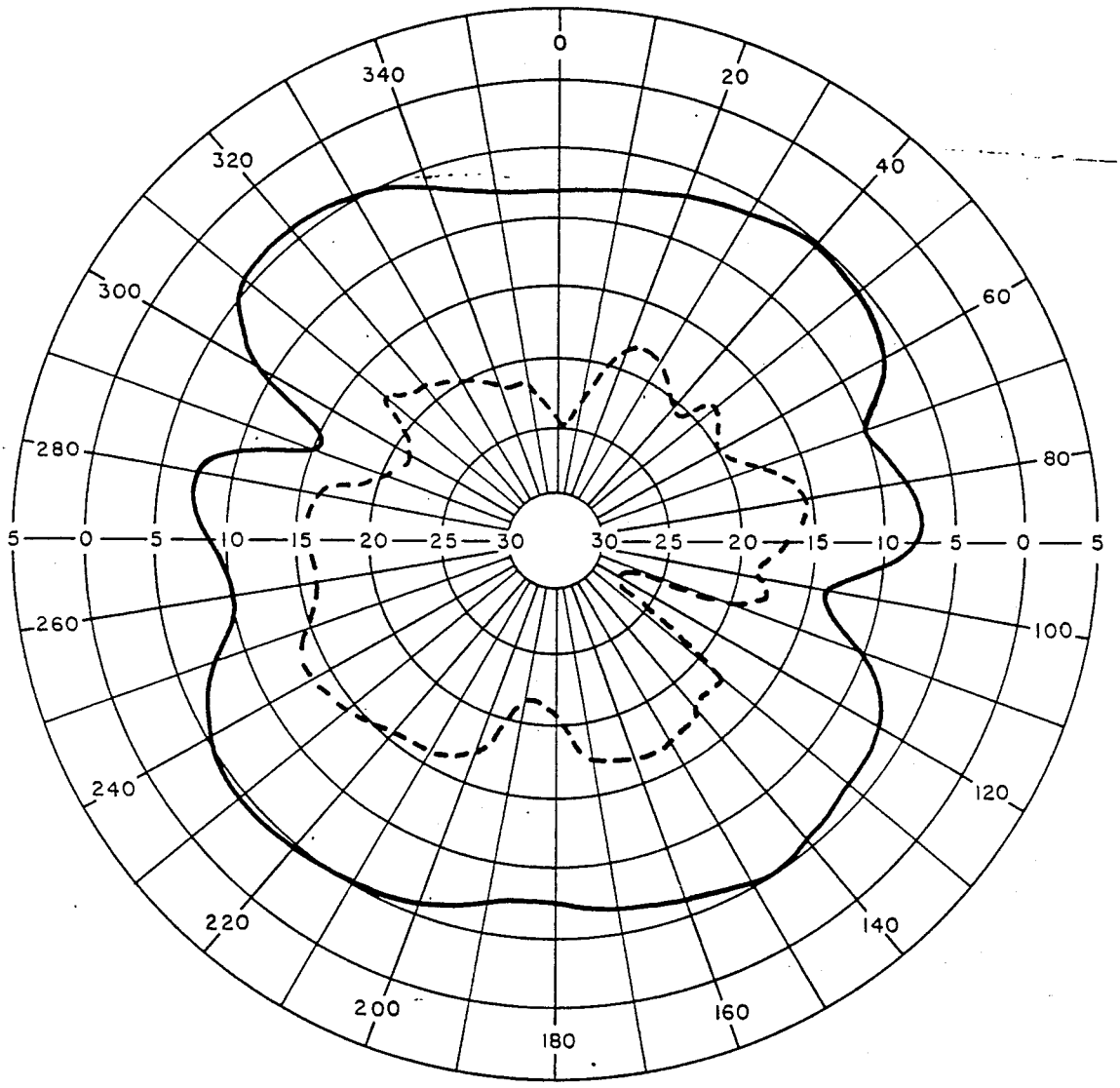
Figure 7:
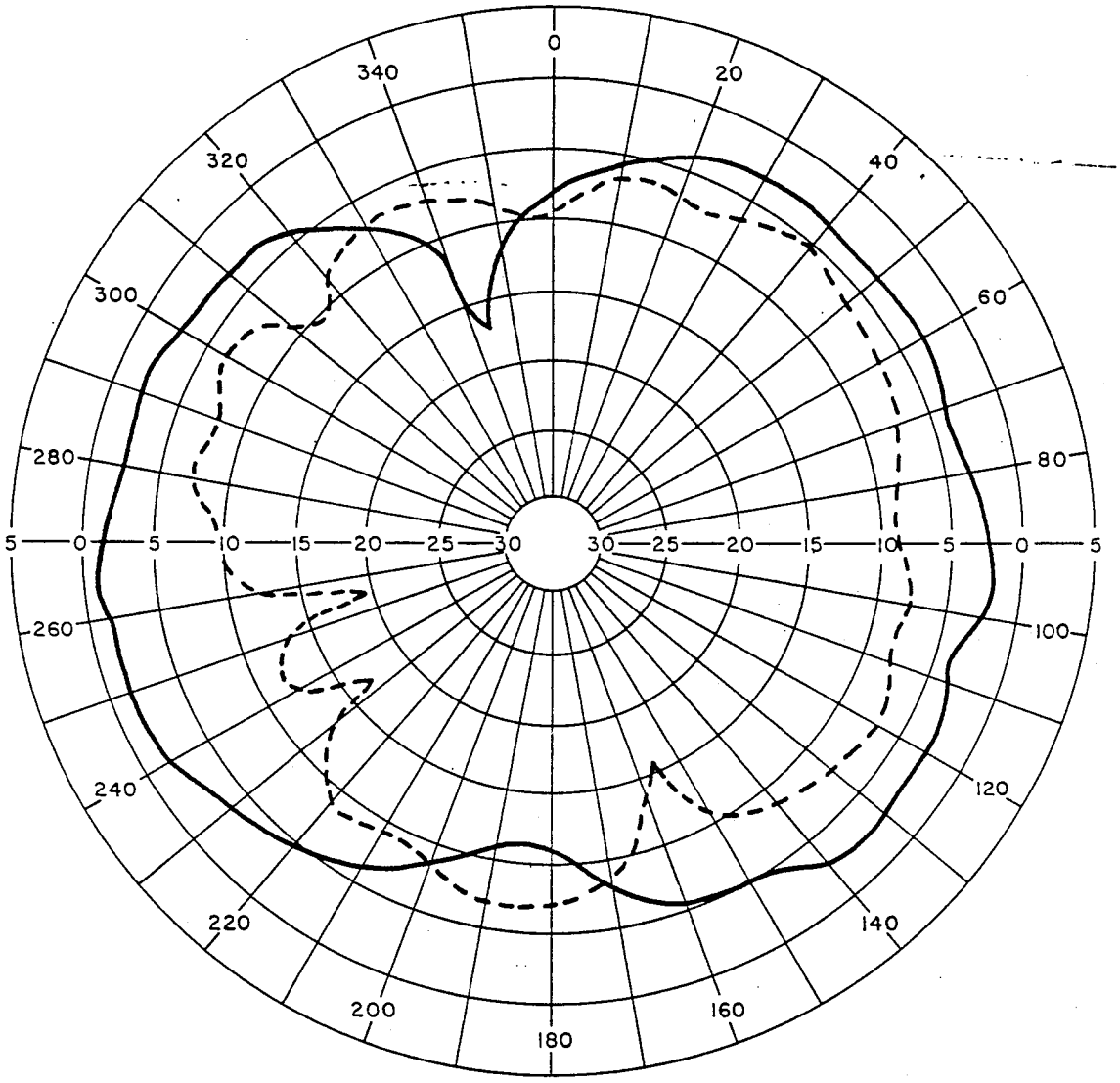
Figure 8:
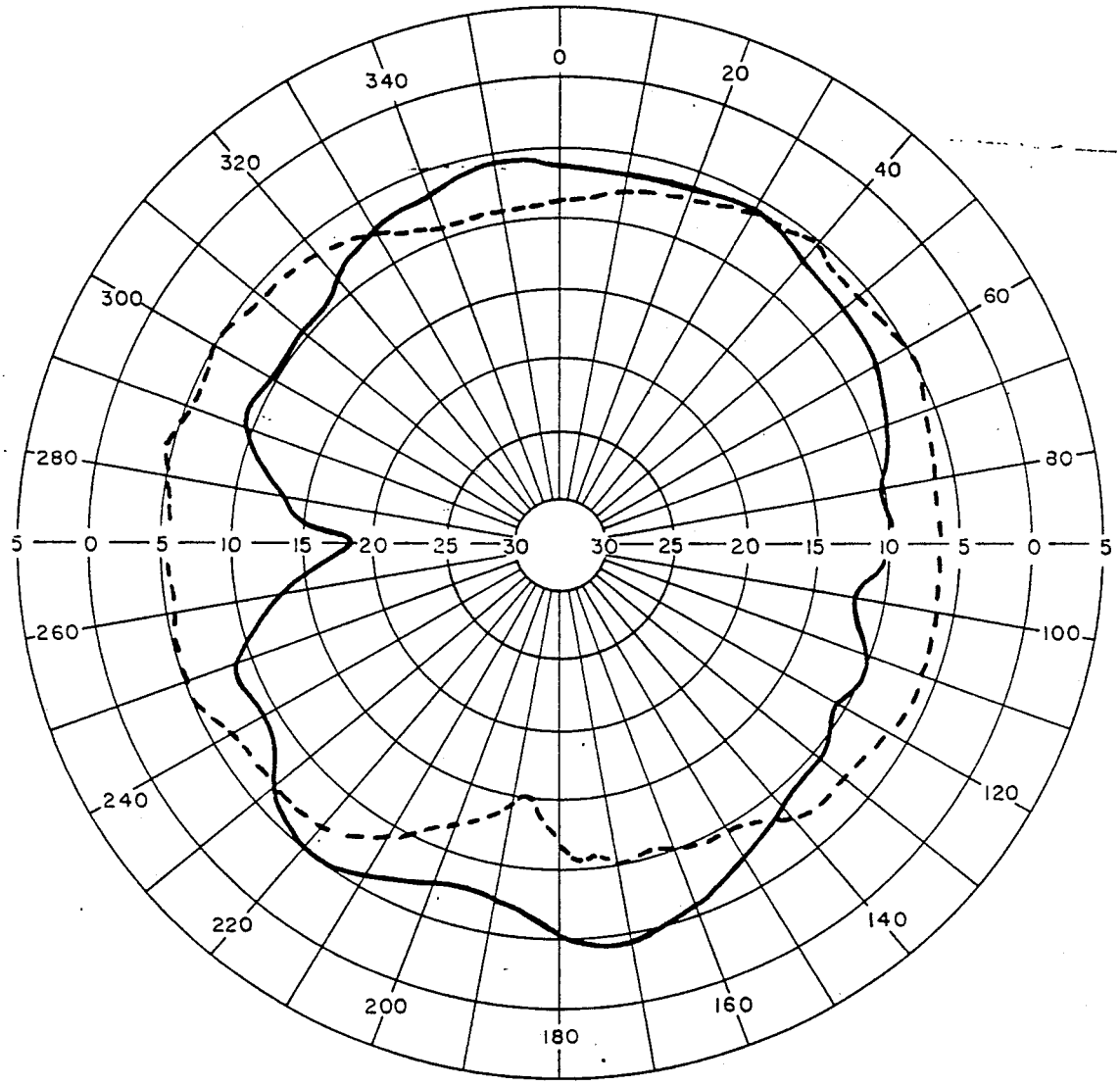
Figure 9:
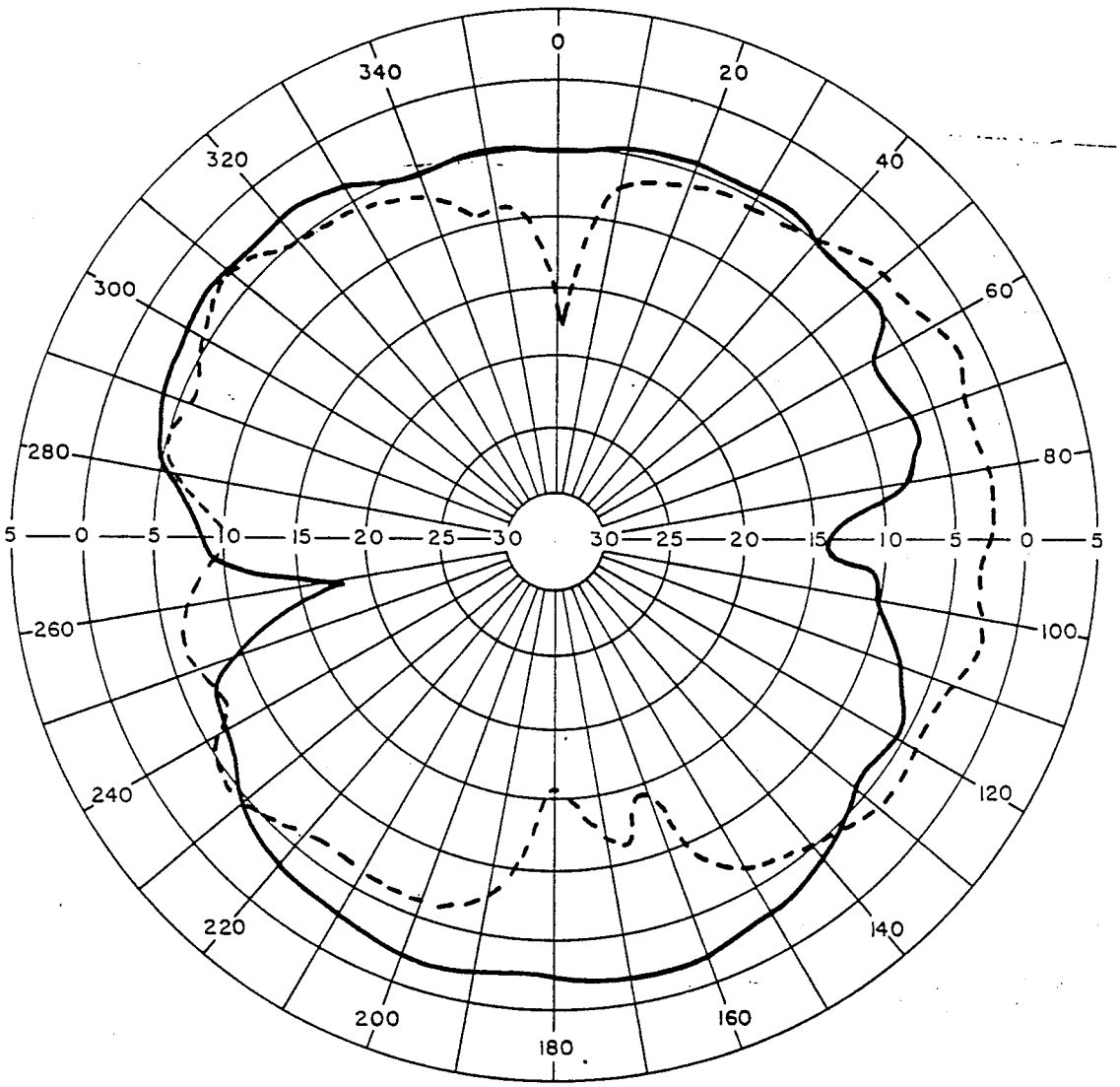

FIGS. 4–9 are series of antenna patterns characteristic of the present invention. The antenna orientation is such that the forward edge of the pod is aligned with θ degrees. The scale is decibels referenced to isotropic (dBi). The solid curve is for vertical polarization, with the weaker gain curves, indicated by dashed lines, indicating the pattern for horizontal polarization. FIGS. 4–6 are measurements of the azimuthal plane, FIG. 4 being the pattern for the low end of the operating frequency range, FIG. 5 being in approximately the center of the range, and FIG. 6 being at the high end of the range. FIGS. 7, 8, and 9 are measurements of the elevational plane, also showing low, middle, and high end of the frequency band covered, respectively. The antenna exhibits substantially omnidirectional characteristics in the vertical polarization mode across the operating frequency band.

It should be recognized that adaptations can be made for frequencies below and above VHF by appropriately scaling the antenna elements. The frequency range could be extended by adding pairs of radiating patches of various lengths. These additional patches could be stacked one over the other to maintain an efficient aerodynamic shape. The invention would operate in the same manner as long as only one pair of patches was electrically active at any one instance in time.

Other advantages and modifications of the present invention may be possible and evident to those skilled in the art. Therefore, it should be understood that the intent is to limit the present invention only by the scope of the claims which follow.

Whereas, I claim:

1. An antenna, comprising:

a first radiating element in the form of a conductive patch;

a second radiating element in the form of a conductive patch, juxtaposed substantially parallel with the first conductive patch along its major axis, so as to form an electrical image of said first radiating element; and a plurality of electronically switchable shorting means having a control input, disposed substantially linearly along and parallel to the major axes of said first radiating and said second radiating element, and operably connected to said first radiating element and said second radiating element.

2. An antenna as recited in claim 1, further comprising:

a control circuit having a plurality of electronic control outputs, each of said electrical control outputs operably connected to a control input of one of said switchable shorting means so that each switchable shorting means can be independently operated.

3. An antenna as recited in claim 1 wherein said first radiating element is in the form of an elongated metallic plane.

4. An antenna as recited in claim 1 wherein said second radiating element is in the form of an elongated metal plane.

5. An antenna as recited in claim 1, further comprising: a solid dielectric medium, disposed between said first radiating element and said second radiating element.

6. An antenna as recited in claim 1, further comprising: means for coupling vertically polarized radio frequency energy to said first radiating element and said second radiating element.

7. An antenna as recited in claim 1 wherein said plurality of electronically switchable shorting switching means comprises a plurality of positive intrinsic negative (PIN) diodes.

8. An antenna recited as in claim 7, further comprising: a compressive sleeve disposed about said PIN diodes and positioned to electrically contact said first radiating element.

9. An antenna for use in airborne radio communications having vertical polarization, of the type configured to be mounted in a pod underneath an aircraft wing, comprising:

a first radiating element, in the form of an elongated metallic patch, shaped to substantially conform to the geometry of the horizontal cross-section of the pod;

a second radiating element, in the form of an elongated metallic patch, to substantially conform to the geometry of the horizontal cross-section of the pod, and juxtaposed parallel to said first radiating element to form the electrical image of said first radiating element; and a plurality of positive intrinsic negative diodes, disposed in a linear line substantially parallel to the major axes of said first radiating element and said second radiating element, and operably connected to said first radiating element and said second radiating element so as to operate as a short between said first and said second radiating elements when biased in its on state, and to operate as a high impedance between said first and said second radiating elements when biased in its off state.

* * * * *